US011654081B2

(12) United States Patent
Sauer

(10) Patent No.: US 11,654,081 B2
(45) Date of Patent: May 23, 2023

(54) OUTDOOR FURNITURE

(71) Applicant: Torsten Sauer, Lübeck (DE)

(72) Inventor: Torsten Sauer, Lübeck (DE)

( * ) Notice: Subject to any disclaimer, the term of this patent is extended or adjusted under 35 U.S.C. 154(b) by 132 days.

(21) Appl. No.: 17/272,751

(22) PCT Filed: Sep. 3, 2019

(86) PCT No.: PCT/EP2019/073453
§ 371 (c)(1),
(2) Date: Mar. 2, 2021

(87) PCT Pub. No.: WO2020/048973
PCT Pub. Date: Mar. 12, 2020

(65) Prior Publication Data

US 2021/0205168 A1 Jul. 8, 2021

(30) Foreign Application Priority Data

Sep. 3, 2018 (EP) ..... 18192233

(51) Int. Cl.

| | |
|---|---|
| ***A47C 7/66*** | (2006.01) |
| ***A47C 13/00*** | (2006.01) |
| ***A61H 33/06*** | (2006.01) |
| ***A47C 1/14*** | (2006.01) |
| ***A47C 7/74*** | (2006.01) |

(52) U.S. Cl.
CPC ..... *A61H 33/067* (2013.01); *A47C 1/14* (2013.01); *A47C 7/666* (2018.08); *A47C 7/748* (2013.01); *A47C 13/00* (2013.01); *A61H 2033/061* (2013.01)

(58) Field of Classification Search
CPC A61H 33/067; A61H 2003/061; A47C 7/748; A47C 7/666; A47C 1/14; A47C 13/00
USPC ..... 4/531
See application file for complete search history.

(56) References Cited

U.S. PATENT DOCUMENTS 2,166,832 A * 7/1939 Wenker ..... A47C 7/66 135/96
2,184,418 A * 12/1939 Faigle ..... A61G 13/009 607/81
3,745,305 A * 7/1973 Reed ..... A61F 7/02 219/217

(Continued)

FOREIGN PATENT DOCUMENTS

DE 1914126 A1 10/1970
DE 19754724 A1 6/1999

(Continued)

*Primary Examiner* — Benjamin R Shaw
(74) *Attorney, Agent, or Firm* — McGlew and Tuttle, P.C.

(57) ABSTRACT

An outdoor furniture item (1) includes at least one seating and/or lying unit (3), a first shell element (5), and a second shell element (7). The first shell element (5) and/or the second shell element (7) can be selectively rearranged into a first configuration and into a second configuration with respect to the respective other shell element (7, 5). In the first configuration, the first shell element (5) and the second shell element (7) are at least partly nested in one another. In the second configuration the first shell element (5) and the second shell element (7) together enclose an essentially closed inner space, in which the at least one seating and/or lying unit (3) is located.

19 Claims, 13 Drawing Sheets

(56) References Cited

U.S. PATENT DOCUMENTS 4,277,855 A * 7/1981 Poss ..... A61H 33/06 4/531
4,495,935 A * 1/1985 Lanier ..... A61F 7/0085 219/211
4,565,188 A * 1/1986 Hardie ..... A61H 33/06 601/16
5,188,099 A * 2/1993 Todeschini ..... A61H 33/06 128/202.25
5,441,529 A * 8/1995 Dorsch ..... A61H 9/00 607/82
8,991,411 B1 * 3/2015 Neuman ..... E04H 15/02 135/96
9,440,041 B1 * 9/2016 Lacayo ..... A61H 33/065
9,782,010 B1 * 10/2017 Bodden-Burdick ... A47C 7/666
11,147,738 B1 * 10/2021 Nunez ..... A61H 33/067
2005/0286877 A1 * 12/2005 Chen ..... A61H 33/063 392/416
2006/0213005 A1 * 9/2006 Tanaka ..... A61H 33/10 4/531
2007/0044233 A1 * 3/2007 Al-Sabah ..... A47C 29/003 5/7
2007/0050903 A1 * 3/2007 Sappenfield ..... A61H 33/06 4/524
2012/0233764 A1 * 9/2012 Lee ..... A61H 33/06 4/524
2014/0304909 A1 * 10/2014 Piispanen ..... A47C 1/13 5/12.1
2015/0342827 A1 * 12/2015 Kim ..... A61F 7/0053 4/524
2016/0081875 A1 * 3/2016 Oh ..... A61H 33/066 4/524
2017/0131693 A1 * 5/2017 Shurtleff ..... H05B 3/0085
2017/0281465 A1 * 10/2017 Takao ..... B05B 5/00
2018/0092805 A1 * 4/2018 Perovic ..... A61H 33/06
2019/0167519 A1 * 6/2019 Kaps ..... A61H 33/066
2019/0358120 A1 * 11/2019 O'Keeffe ..... H05B 3/009
2020/0032542 A1 * 1/2020 Clark ..... E04H 15/48
2020/0329877 A1 * 10/2020 Feldmann ..... A47C 29/003
2021/0059894 A1 * 3/2021 Niu ..... A61H 33/066
2021/0113429 A1 * 4/2021 O'Keeffe ..... G06Q 50/22
2021/0177694 A1 * 6/2021 Arnold ..... A61H 33/065
2021/0386620 A1 * 12/2021 Zack ..... A61H 33/063

FOREIGN PATENT DOCUMENTS

DE 10000545 A1 8/2001
DE 102006006908 A1 1/2007
EP 2476402 A2 7/2012
JP H0663099 A 3/1994
JP 2535978 Y2 5/1997
KR 930000326 U 1/1993
KR 100999991 B1 12/2010
KR 20180091508 A 8/2018

* cited by examiner

OUTDOOR FURNITURE

CROSS REFERENCE TO RELATED APPLICATIONS

This application is a United States National Phase Application of International Application PCT/EP2019/073453, filed Sep. 3, 2019, and claims the benefit of priority under 35 U.S.C. § 119 of European Application 18192233.7, filed Sep. 3, 2018, the entire contents of which are incorporated herein by reference.

TECHNICAL FIELD

The invention relates to outdoor furniture item, in particular with a sun and/or rain protection function, for the garden or beach, such as beach chairs.

TECHNICAL BACKGROUND

Beach chairs are usually used in the garden or on the beach in the spring and summer months, in order to be able to sit or lie therein in a manner protected from sun and/or the wind. Beach chairs mostly provide two seating spaces which are arranged next to one another on a two-seat bench and whose common back rest can be pivoted in its inclination together with the basket which protects from the sun and/or wind. A calf rest which can be pulled out for a lying function is often located below the seating spaces.

Commercial beach chair owners in the autumn and winter months bring in their beach chairs from the beach into dry winter storage at a significant expense with regard to labor, since the demand for beach chairs is low in winter and otherwise the beach chairs would weather on the beach unused during the winter. With regard to the private use of beach chairs in the garden, a tent-like covering is often drawn over the beach chair against weathering in autumn and winter. An ugly tent mass then stands unused in the garden in the autumn and winter months.

SUMMARY

It is therefore an object of the present disclosure to design an outdoor furniture item, for instance a beach chair, to the extent that it can be usefully used in the autumn and winter months and is protected from the weather.

The basic idea of the present disclosure lies in designing an outdoor furniture item, such as for instance beach chair, to be able to be refunctioned as a sauna cabin, a changing cabin, a garden shed and/or as a storage space.

According to the present disclosure for technically implementing this idea, an outdoor furniture item is provided with—at least one seating and/or lying unit,—a first shell element,—and a second shell element, wherein the first shell element and/or the second shell element can be selectively rearranged into a first configuration and into a second configuration with respect to the respective other shell element, wherein in the first configuration the first shell element and the second shell element are at least partly nested in one another and in the second configuration the first shell element and the second shell element together enclose an essentially closed inner space, in which the at least one seating and/or lying unit is located.

The first configuration can therefore be equated to a beach chair configuration, concerning which a user can use the seating and/or lying unit in the spring or summer, wherein the shell elements which are at least partly nested in one another form a wind protection and/or sun protection to the rear of the user. The second configuration can be equated to a cabin configuration, concerning which the shell elements form a closed inner space which can be used as a sauna cabin, a changing cabin, a garden shed and/or as a storage space. The closed inner space, in which the seating and/or lying unit is located, is protected from rain and weathering by the shell elements. In the second configuration, the interior is preferably effectively thermally closed to a minimal extent, i.e. with a heat transfer coefficient (U-value) of at the most 10 $W/(m^2 \cdot K)$, preferably below 5 $W/(m^2 \cdot K)$ to both sides, to the front, to the rear and to the top. The heat transfer coefficient can possibly be greater to the bottom. Deliberate ventilation openings and/or holes or slots which arise from manufacturing tolerances or material distortions do not negate the "essentially closed" inner space, inasmuch as the thermal loss which is due to such is small enough in order to be compensated for example by a sauna heating stove. Herein, what is meant by "can be rearranged" or "rearranged" is a repositionability or a repositioning, wherein the shell elements which are arranged in a manner in which they are releasable from one another are separated from one another and are repositioned on one another again with a changed alignment to one another. A pivotability or a pivoting of the shell elements to one another, concerning which the shell elements remain connected to one another, is not meant here by "rearrangeable" or "rearranged".

One of the shell elements or both can be movable with respect to the respective other shell elements for the conversion of the outdoor furniture item between the two configurations. Depending on the embodiment, it lends itself for preferably only the shell element which is designed in a more lightweight manner to be moved, whilst the heavier shell element remains in place. However, both shell elements can also be moved and can be moved to one another as well as with respect to the overall position and overall alignment of the outdoor furniture item. One of the shell elements or both can preferably be carried or rolled, rotated and rearranged manually by one or two persons by way of handgrips. One of the shell elements or both can be designed as one piece or in a multi-part manner. A one-part design is preferable, in order to increase the stability and to reduce the variety of parts. A multi-part design can be advantageous if a single-part design is too heavy to rearrange. The shell elements are preferably designed in a rigid manner and as stiff in bending as possible.

Optionally, in the first configuration, the at least one seating and/or lying unit can be located in the first shell and be orientated towards an open front side of a first shell element. The seating and/or lying unit can then stand on a base of the first shell element. Such a base can be a fixed constituent of the first shell element.

The first shell element can therefore be defined as an inner shell element which in the first configuration as a beach chair is at least partly inserted into the second shell element or second shell element is placed onto a rear side of the first shell element.

Optionally, the first shell element can define a first semi-space which is open to a front side of the first shell element, and the second shell element can define a second semi-space which is open to the front side of the second shell element. The first shell element and the second shell element herein with regard to shape and size can correspond to one another such that in the first configuration the shell element essentially fills out the second semi-space. The shape of the shell elements can correspond essentially to non-closed polyhedrons or prisms, wherein the shell elements set upon one another in the second configuration can supplement one another into a closed polyhedron or prism. In the first configuration, the surfaces of the rear side, side walls and roof of the second shell element each preferably run essentially parallel to the respective rear side, the side walls and the roof of the first shell element.

Optionally, in the second configuration, the first semi-space and the second semi-space together form the essentially closed inner space, wherein the front side of the first shell element and the front side of the second shell element bear on one another in a manner directed to one another. The shell elements placed on one another in the second configuration essentially form the shape of a geometric prism with a preferably essentially mirror-symmetrical pentagon as a base surface which is formed by the side walls of the shell elements.

The second semi-space is preferably wider and/or higher than the first semi-space. In the second configuration, such a large size difference is compensated by a panel which runs transversely to the front side, in order in the second configuration to close the inner space at the transition between the shell elements. The panel can preferably form the front side of the first shell element and in the second configuration serves as a stop for the front side of the first shell element.

Optionally, the at least one seating and/or lying unit can be movable with respect to the first shell element and/or the second shell element, preferably is insertable or rearrangeable into the first shell element and/or the second shell element as a separate unit. In particular, this makes sense in an embodiment concerning which the second shell element which lies at the outside in the first configuration is designed as lightweight and stable as possible. Given a movable or insertable or rearrangeable (repositionable) seating and/or lying unit, a door can be provided in the heavier first shell element, since in the second configuration the seating and/or lying unit can be pushed into the second shell element. The seating and/or lying unit can possibly be rotated in its alignment by 180° prior to this, so that in the second configuration the viewing direction of a person positioned on the seating and/or lying unit is directed from the inside onto a window in the rear side of the first shell element. A window or a door in the second shell element which is as lightweight and stable as possible is not therefore necessary and such would render the second shell element unnecessarily heavier and more instable.

Optionally, the second shell element can comprise a base which is rearrangeable or can be folded over and which in the first configuration bears in a surfaced manner on a rear side and/or side wall of the second shell element and in the second configuration forms a base part of the essentially closed inner space. Herewith, it is particularly simple to place the second shell element from the rear onto the first shell element, for the first configuration.

Optionally, the first shell element and/or the second shell element can comprise a door in a side wall. The door can be a pivoting door or a sliding door. The door can open to the inside and/or to the outside, wherein it is preferable for the door to open to the outside. The door is preferably provided in the heavier of the two shell elements which is not moved between the two configurations for the conversion of the outdoor furniture item. Given a seating and/or lying unit which is fixedly installed in the first shell element and which cannot be displaced or repositioned, the door is preferably arranged in the second shell element even if the movement of the second shell element is to be envisaged for the conversion of the outdoor furniture item between the two configurations.

Optionally, the outdoor furniture item can comprise a sauna heating stove in the first or second shell element. Herewith, the second configuration can be denoted as a sauna configuration, concerning which the interior which is formed by the shell elements in the second configuration can be heated by way of the sauna heating stove and can serve as a sauna cabin.

Optionally, in the first configuration, the at least one seating and/or lying unit can cover the sauna heating stove and in the second configuration can be arranged in the second shell element remotely from the sauna heating stove and directed towards the sauna heating stove. In this embodiment, the seating and/or lying unit is preferably movable or repositionable and the sauna heating stove is fixedly installed in the first shell element. On conversion from the first configuration into the second configuration, the seating and/or lying unit can possibly be rotated in its alignment by 180° and in the second configuration can be pushed away from the sauna heating stove out of the first shell element into the second shell element. In the first configuration, the sauna heating stove which is not required can be hidden and securely stowed in a space-saving manner below or behind the seating and/or lying unit.

Optionally, the sauna heating stove can be arranged in a corner region which is formed by a side wall of the first shell element with a rear side of the first shell element, wherein the side wall of the first shell element which lies opposite this side wall comprises a door which preferably opens to the outside. Herewith, the sauna heating oven does not block the entrance region of the door and is as far as possible from the door and from the seating and/or lying unit which is pushed onto the rear side of the second shell element.

Optionally, the sauna heating stove can be electrically operated, preferably with 230±23V mains voltage, or with gas, preferably via a propane gas bottle or a gas tank. For an electrical operation via a lead which is fused up to 16 A with a mains voltage of 230±23 V, the sauna heating stove is preferably designed with a heating power of less than 3680 W. Trial tests have resulted that given an inner space volume of about 4 $m^3$ and a defined wall construction of the shell elements, such a heating power is sufficient, in order to achieve a temperature difference of 100° C. and more between the inner space and the outer temperature and to maintain this. Herewith, the inner space can therefore be used as a sauna in the second configuration. On operation with gas or via an electrical connection which is specially designed for higher powers, greater heating powers can also be possibly achieved. The operation with gas for example is advantageous when no electricity connection is in the proximity and/or high heating powers are necessary, such not being able to be met via a common electricity connection.

Optionally, the first shell element and/or the second shell element at a respective rear side can comprise a window of glass and/or of transparent plastic. This on the one hand permits a natural incidence of light in the second configuration given a closed door and on the other hand a view to the outside when in the sauna. Preferably, the window is arranged in the shell element, in which the seating and/or lying unit is not positioned in the second configuration. Given a seating and/or lying unit which is fixedly attached in the first shell element, the window is therefore preferably arranged in the rear side of the second shell element. Given a rearrangeable seating and/or lying unit which in the second configuration is pushed into the second shell element, the window is preferably in the rear side of the first shell element. In order to increase the incidence of light and the possibilities for the positioning of the seating and/or lying unit, both rear sides and/or the roof and/or the side walls can also comprise windows of glass and/or of transparent plastic.

Optionally, the first shell element and/or the second shell element can comprise walls with at least two, preferably three solid body layers and at least one metal foil which lies between the solid body layers, reflects radiant heat and preferably serves as a vapor block. Herewith, the loss of radiant heat is reduced and the heating process can be greatly shortened in regard to time, so that the energy consumption is reduced. Furthermore, one can make do without fibre insulation materials which on the one hand are heavier and on the other hand can become moist and thus lose their insulating properties and have a tendency to form mould. Condensation water can run down on the metal foil which preferably also serves as a vapor block and at the lower side can be led to the outside in a controlled manner for evaporation or for dripping away. Optionally, the outdoor furniture item can comprise one (or more) air gaps which lie between the solid body layers. The at least one metal foil can preferably be arranged on a side of one or more of the solid body layers, said side facing the respective air gap. Such a hollow chamber structure as a wall construction of the shell elements has at least one thermally insulating, stagnant air layer which reduces the thermal loss and lowers the required heating power of the sauna heating stove to such an extent that this can be operated electrically with a mains voltage of 230±23 V via a lead which is fused up to 16 A. One or more of the solid body layers preferably consist of wood, in particular the layer which is adjacent to the inner space. One or more of the solid body layers, in particular the outer-lying layer however can comprise another material such as for example plastic and/or fibre composite material. One or more of the solid body layers can for example themselves comprise particularly well thermally insulating material such as artificial cork and/or natural cork. Given an adequate thermal insulation by way of solid body layers, one can make do without a hollow chamber structure with an air gap.

Optionally, the first shell element and/or the second shell element can comprise essentially vertically running side walls, a rear side which is inclined to the rear by an angle ß in the range of 3° to 15° and a sloped roof which is inclined to the rear by a roof inclination γ in the range of 5° to 20°. Amongst other things, by way of this an optical impression of a beach chair with a lean-to roof arises in the first configuration and of a garden shed with a gable roof in the second configuration. The rear sides, possibly with windows, are furthermore protected directly to the top from rain. Furthermore, it permits a back rest of the seating and/or lying unit to be set at a deeper lying position, without for this having to increase the distance of the seating surface from the rear side. The sloped roof ensures that rain water runs off to the rear sides.

Optionally, the roof inclination γ is larger than the angle ß at which the rear sides are inclined to the rear. This on the one hand provides a harmonic, aesthetically pleasing shape as well as a high stability of the outdoor furniture item in the first as well as in the second configuration.

Optionally, a front side of the first shell element can be shouldered in a stepped manner such that a lower section of the front side of the first shell element projects with respect to an upper section of the front side of the first shell element. By way of this, the optical impression of a beach chair is amplified in the first configuration and a placement surface is provided in the first configuration. Optionally, herein a front side of the second shell element can be shouldered in a stepped manner corresponding to the front side of the first shell element such that a lower section of the front side of the second shell element is set back with respect to the upper section of the front side of the second shell element. Herewith, the two shell elements supplement one another in an exactly fitting manner into a closed space in the second configuration. On account of the front sides of the shell elements which are shouldered in a manner corresponding to one another, a horizontal section can be formed in the first front side, on which horizontal section the second shell element lies in the second configuration. By way of this, the stability and the statics of the outdoor furniture item are improved in the second configuration. In the first configuration, the horizontal section contributes to a more beach-chair-like appearance and can serve as a placement surface, for example for drinks or tableware.

The invention is hereinafter explained in more detail by way of embodiment examples which are represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
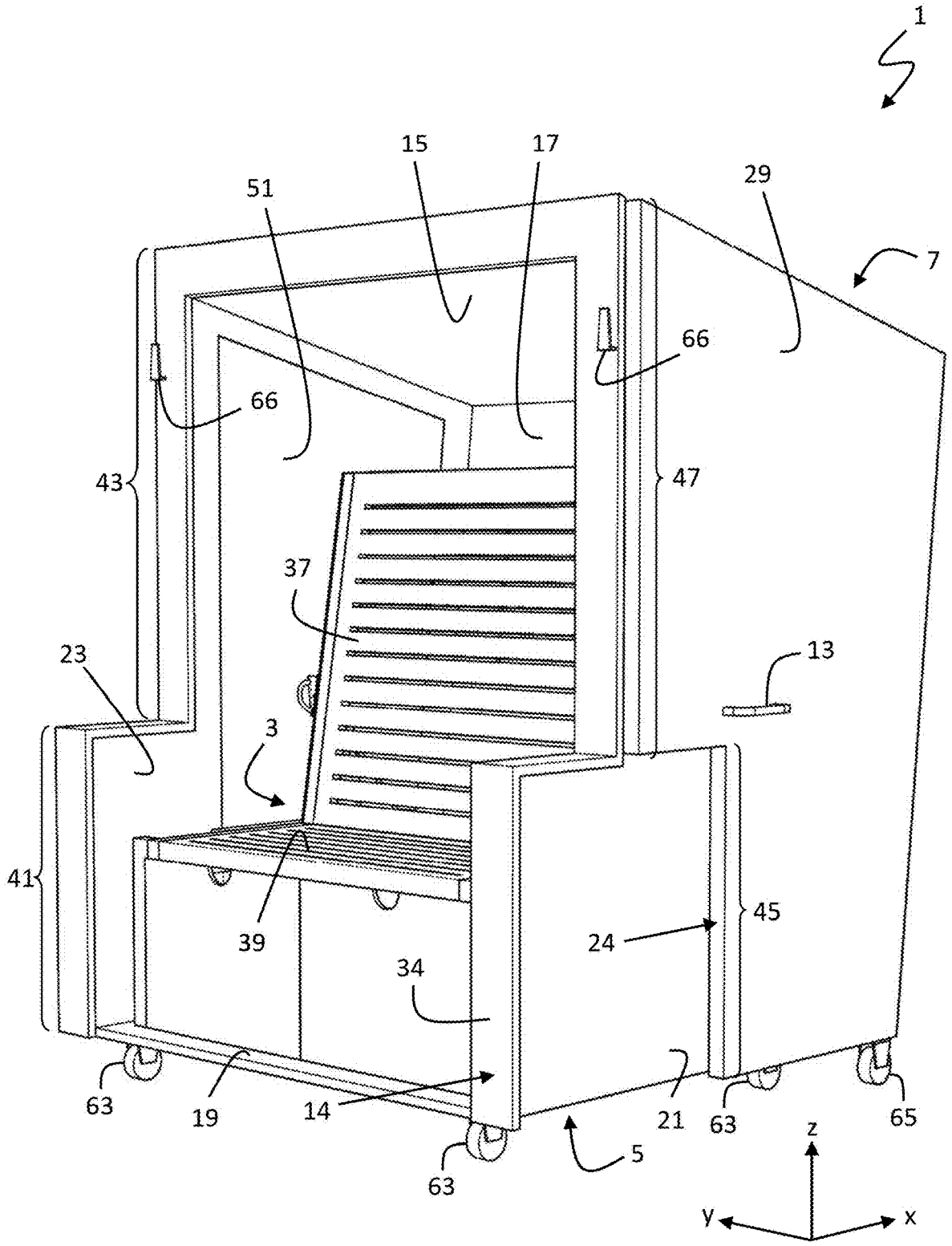
FIG. 1 is a perspective view upon an exemplary first embodiment of the outdoor furniture item which is disclosed herein, in the first configuration.

Referring to the drawings, an outdoor furniture item 1 is shown in FIG. 1 in a first configuration, concerning which the outdoor furniture item 1 is optically and functionally similar to a beach chair. For an improved orientation, a right-handed Cartesian coordinate system is shown in the figures in each case, concerning which the x-axis runs in the depth direction, the y-axis in the width direction and the z-axis in the height direction. Here, the x-axis is randomly selected such that it corresponds to a viewing direction upon a front side of the outdoor furniture item 1 in the first configuration. The y-axis here is randomly selected such that given a viewing direction upon the front side of the outdoor furniture item 1 in the first configuration, it runs from the right to the left. From this it results that the z-axis runs vertically from the bottom to the top. The term "front side" or "front" is herein selected for all parts of the outdoor furniture item 1 such that what is meant herewith it is the side or direction which faces or points in the negative x-direction in the first configuration. In a second configuration of the outdoor furniture item 1 however, a "front side" of a movable part can face in the positive x-direction. Analogously, the term "rear side" or "rear" is herein selected for all parts of the outdoor furniture item 1 such that what is meant by this is the side or direction which faces or points in the positive x-direction in the first configuration. In a second configuration of the outdoor furniture item 1 however, a "rear side" of a movable part can face the negative x-direction.

The outdoor furniture item 1 comprises a seating and/or lying unit in the form of a two person seating bench 2, a first shell element 5 and a second shell element 7. The first shell element 5 forms a first semi-space 9 which is open to the front and in which the two-person seating bench 2 is arranged and which is directed to the front towards the opening in the negative x-direction. The first shell element 5 similarly to a beach chair forms a rain wind and/or sun protection from the rear, from the sides and from above, for a person who is positioned on the two-person seating bench 3. The second shell element 7 is movable with respect to the first shell element 5 and is placed onto the first shell element 5 in the manner of a hood. The first shell element 5 and the second shell element 7 are therefore nested in one another, wherein the first shell element 5 almost completely fills out a second semi-space 11 which is formed by the second shell element 11 (see FIG. 4). The second shell element is designed as lightweight and stiff in bending as possible, in order to be able to be removed and to be repositioned with respect to the first shell element 5 by one or two persons by hand by way of grips 13.

Figure 2:
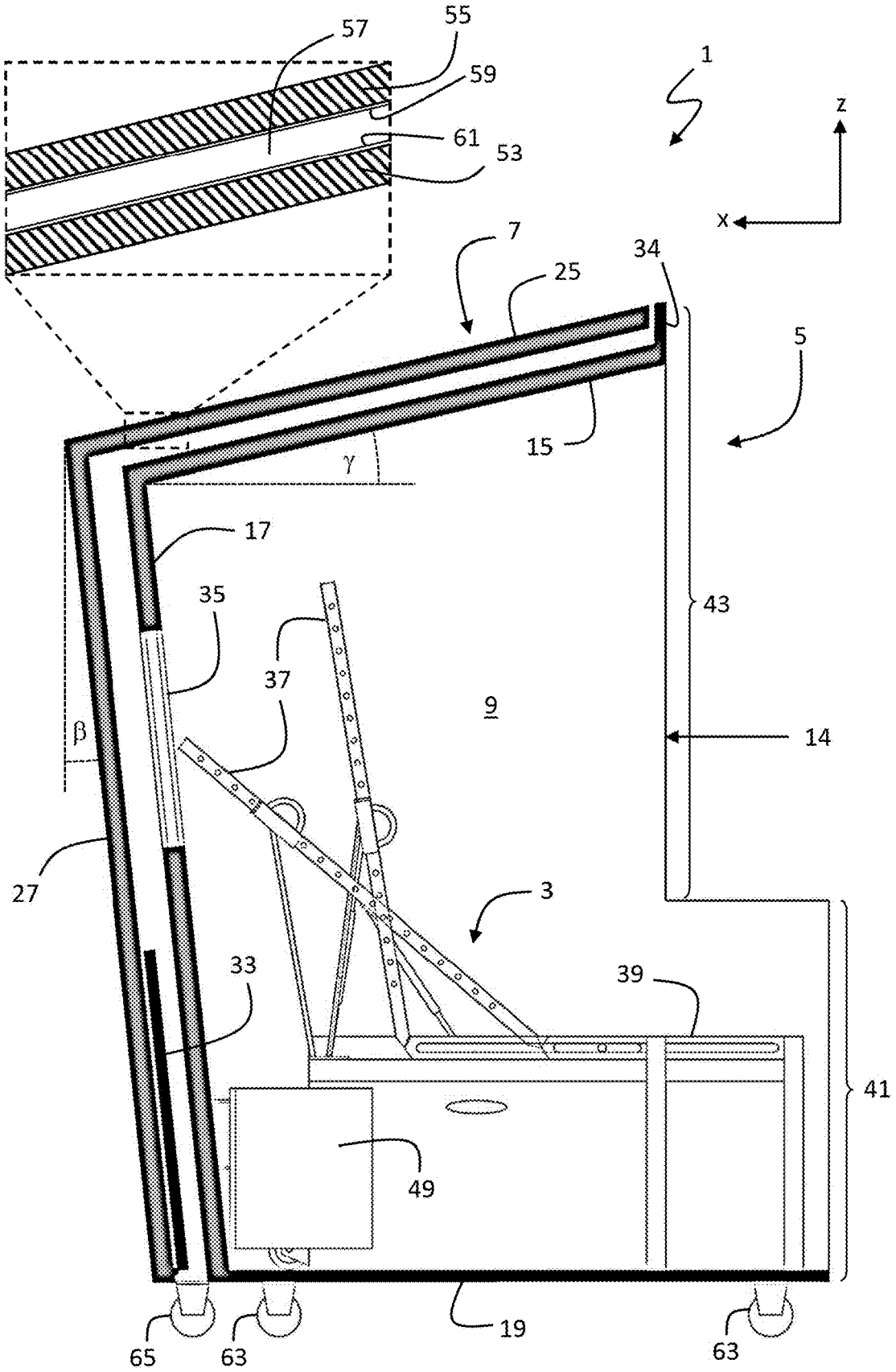
FIG. 2 is a longitudinal sectional view in the xy-plane through an exemplary first embodiment of the outdoor furniture item which is disclosed herein, in the first configuration.

The longitudinal section in the xz-plane, shown in FIG. 2, shows the nesting of the shell elements 5, 7 within one another in the first configuration in a clearer manner. The inner-lying first shell element 5 essentially forms a pentahedral polyhedron which is open towards a first front side 14, with a first sloped roof 15, a first rear side 17, a first base 19 and two first side walls 21, 23 (not visible in FIG. 2, but in FIGS. 1 and 5). The outer-lying second shell element 7 in the first configuration essentially forms a tetrahedral polyhedron which is open to a second front side 24 as well as to the bottom, with a second sloped roof 25, a second rear side 27 and two second side walls 29, 31 (not visible in FIG. 2, but in FIGS. 1 and 5). In the first configuration, a second base 33 of the second shell element 7 is folded up or set upright on the second rear side at the inner side, so that in the first configuration it lies between the first rear side 17 and the second rear side 27 essentially parallel to these.

The sloped roofs 15, 25, the rear sides 17, 27 as well as the side walls 21, 23, 29, 31 each lie parallel to one another in the first configuration. The side walls 21, 23, 29, 31 herein run essentially vertically. The rear sides 17, 27 are inclined to the rear by an angle ß in the range of 3° to 15°, preferably by 6°, so that the optical impression of the beach chair is achieved and the rear sides 17, 27 are exposed less to the rain. The sloped roofs 15, 25 are inclined to the rear by a roof inclination γ in the range of 5° to 20°, preferably by 13° and in the first configuration form a lean-to roof, on which rainwater flows away to the rear. The first front side 14 is shouldered in a stepped manner such that a lower section 41 of the first front side 14 projects with respect to an upper section 43 of the first front side 14. As can be easily recognized from FIG. 1, the second front side 24 in a manner corresponding thereto is shouldered in a stepped manner such that a lower section 45 of the second front side 24 is accordingly set back with respect to an upper section 47 of the second front side 24. The first front side 14 here is formed by a frame-forming panel 34 which extends perpendicularly to the xz-plane and which to the rear partly covers the view onto the second front side 24. In the second configuration, the panel 34 serve as a stop for the front side 24 of the first shell element 7 (see FIGS. 3 and 4). Due to the front sides 14, 24 of the shell elements 5, 7 which are stepped in a manner corresponding to one another, the panel 34 here forms a horizontal section, on which the second shell element 7 lies in the second configuration. By way of this, the stability and the statics of the outdoor furniture item 1 is improved in a second configuration. In the first configuration, the horizontal section of the panel 34 contributes to the beach-chair-like overall appearance and can serve as a placement surface, for example for drinks or tableware.

The first rear side 17 comprises a window 35, which preferably comprises thermally-insulating double or triple glazing. The window 35 can have one or more panes which comprise glass and/or transparent plastic. The window 35 can have a discretion layer for tinting the view, in particular from the outside to the inside.

Figure 3:
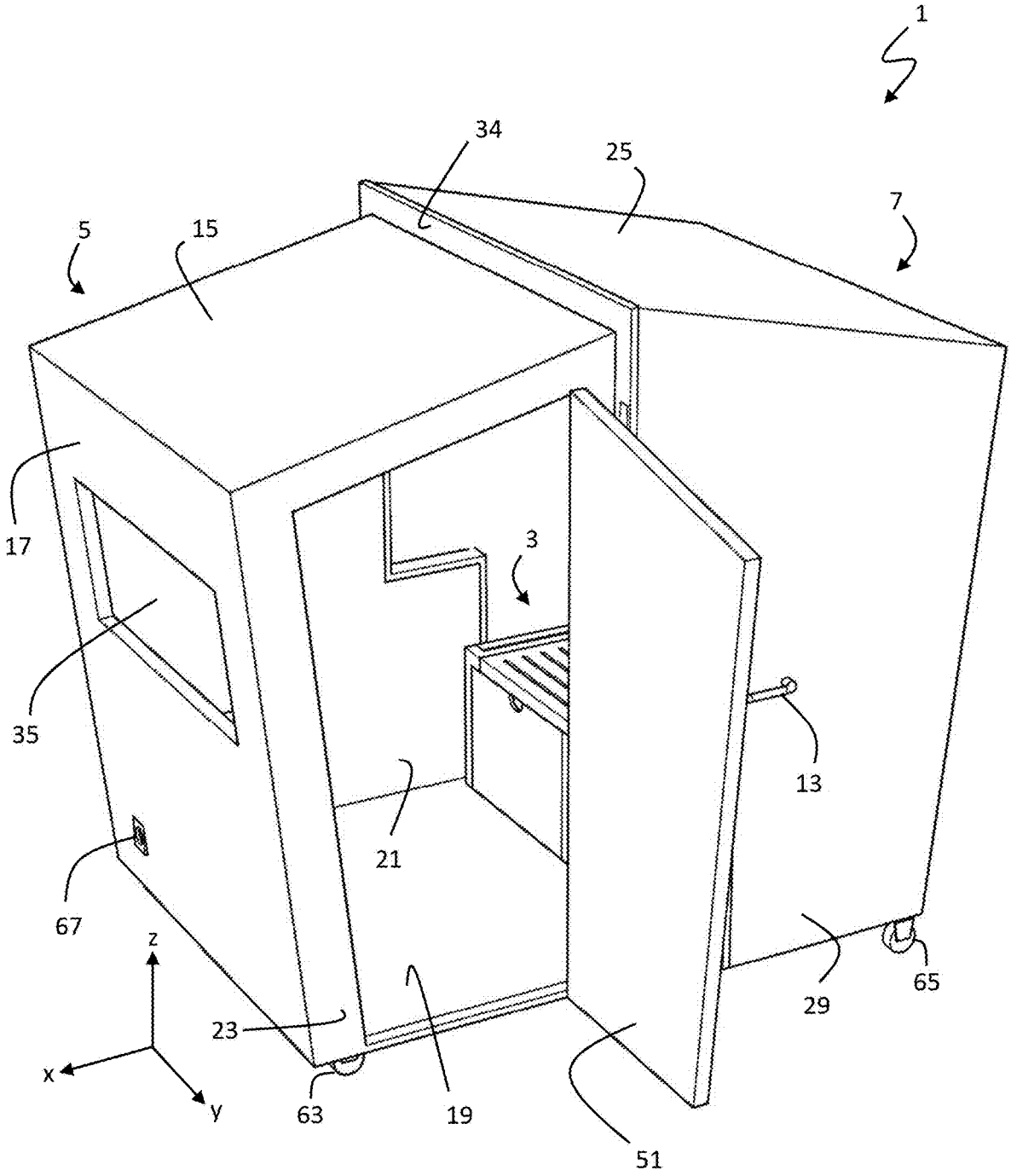
FIG. 3 is a perspective view upon an exemplary first embodiment of the outdoor furniture item which is disclosed herein, in the second configuration.
Figure 4:
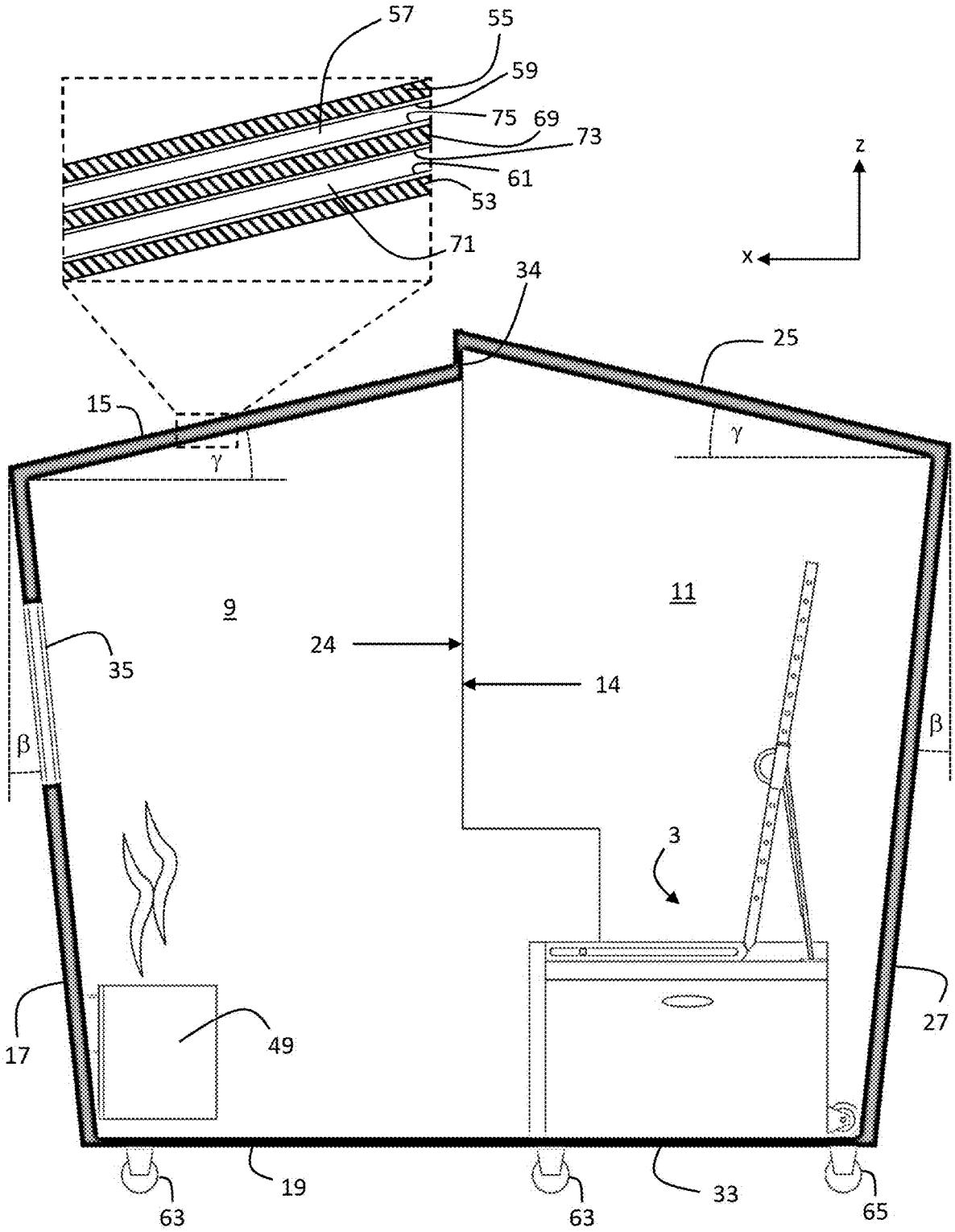
FIG. 4 is a longitudinal sectional view in the xz-plane through an exemplary first embodiment of the outdoor furniture item which is disclosed herein, in the first configuration.
Figure 5:
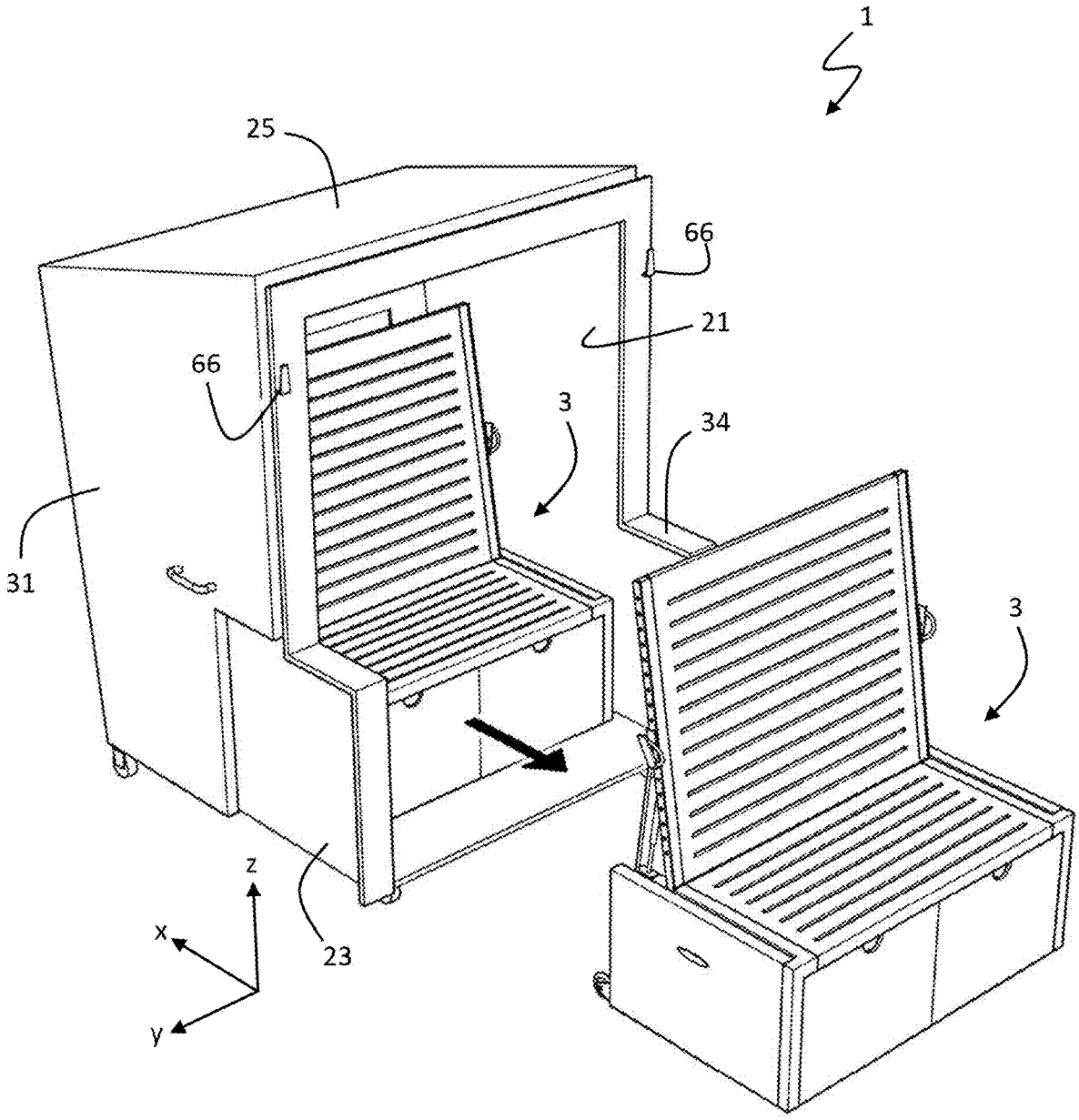
FIGS. 5 to 10 are perspective views upon an exemplary first embodiment of the outdoor furniture item which is disclosed herein, in different phases of a stepwise conversion from the first configuration into the second configuration.

The two-person seating bench 3 in the embodiment according to FIGS. 1 to 10 stands on the first base 19 and is movably displaceable in the first shell element 5 and can even be taken out (see FIG. 5). A back rest 37 of the two-person seating bench 3, as is shown in FIG. 2, is adjustable in its inclination to the rear in a stepped or continuous manner. Herein, a seating surface 39 of the two-person seating bench 3 can be displaced horizontally to the front (in the negative x-direction) or the complete two-person seating bench 3 can be positioned further to the front in the first shell element 5, in order to have more space at the rear for the rearward positioning of the back rest 37. A calf support can be pushed out and folded up at the front on the seating surface 30 of the two-person seating bench 3 for a lying function, said calf leg support possibly projecting out of the first front side 14.

A sauna heating stove 49 which can be electrically operated via a conventional 230V electricity mains connection is arranged below or behind the seating surface 39 of the two-person seating bench 3 in a hidden manner. The sauna heating stove 49 is not envisaged for operation in the first configuration according to FIGS. 1 and 2, but is only stowed for the use in the second configuration according to FIGS. 3 and 4. Here, the sauna heating stove is arranged in a corner region which is formed by the right first side wall 21 with the first rear side 17. The left first side wall 23 which lies opposite the right first side wall 21 herein comprises a preferably outwardly opening door 51 (see FIG. 3).

In FIG. 2, the hollow chamber structure of the second shell element 7 is shown in a detailed section. The first shell element 5 can have the same hollow chamber structure and/or a hollow chamber structure which is shown in FIG. 4. Preferably, the sloped roofs 15, 25, the rear sides 17, 27 as well as the side walls 21, 23, 29, 31 all comprise a hollow chamber structure according to FIG. 2 and/or FIG. 4. The hollow chamber structure according to FIG. 2 comprises two wooden layers 52, 55 with a stagnant air gap 57 which lies therebetween. A metal foil, preferably comprising aluminum and reflecting radiant heat is arranged on the wooden layers 53, 55 towards the air gap 57. Herewith, the loss or radiant heat is reduced by stagnant air gap 57, additionally to the thermal insulation, and the heating-up procedure is greatly shortened with regard to time, so that the energy consumption is reduced. Furthermore, one can make do without fibre isolation materials which on the one hand are heavier and on the other hand can become damp and herewith lose their insulating effect and can have a tendency to form mould. The metal foils 59, 61 furthermore act as a vapor block, so that condensation water can run down on the metal foils and at the lower side can be led to the outside in a controlled manner for evaporation or for dripping away. Compared to the hollow chamber structure according to FIG. 4, the hollow chamber structure according to FIG. 2 has the advantage that the respective shell element 5, 7 can be designed more lightweight and in particular is suitable for the shell elements 5, 7 to be repositioned (here the second shell element 7).

For simplifying the repositioning of the shell elements 5, 7, these here are designed in a rollable manner on rollers 63, 65. The first shell element 5 stands with the first base 29 on four first rollers 63, and the second shell element 7 stands with the second rear side 27 or the second side walls 29, 31 on two second rollers 65.

FIGS. 3 and 4 show the outdoor furniture item 1 in a second configuration, concerning which the outdoor furniture item 1 is optically and functionally similar to a sauna cabin or a garden shed. The first semi-space 9 and the second semi-space 11 in the second configuration together form a closed inner space which can be entered via the door 51. The first front side 14 and the second front side 24 herein bear on one another in a manner directed to one another. Herein, the second shell element 7 is suspended on the front-side panel 34 of the first shell element 5 by way of holders 66. The holders 66 comprise a male part on the front side panel 34 of the first shell element 5 in the form of upwardly obliquely tapering hooks. Corresponding to the male part on the front-side panel 34 of the first shell element 5, the second shell element 7 on the second front side 24 comprises female parts of the holders 66 in the form of downwardly obliquely tapering receivers. The holders 66 can be shaped such that a wedging takes place due to corresponding obliquely tapering surfaces and/or the second shell element 7 is pressed by its intrinsic weight onto the first shell element in the x-direction. A sealing lip (not shown) can run along the second front side, said sealing lip in the first configuration being covered at least partly by the panel 34 and being protected from sun radiation and in the second configuration sealingly bearing on the panel 34 at the front side, in order to thermally seal the inner space which is formed by the shell elements 5, 7, to an improved extent. Such a sealing lip can also serve as an elastic protection cushion, in order to avoid a scratching of the panel 34 by the second front side 24.

The slightly different size of the shell elements 5, 7 is compensated by the frame-forming panel 34. In order for the second shell element 7 to be able to be placed onto the first shell element 5 in the first configuration, the second side walls 29, 31 have a greater distance to one another than the first side walls 21, 23. The second semi-space 11 in the y-direction is therefore wider than the first semi-space, so that the formed closed inner space has an offset. By way of the frame-forming panel 34 which extends perpendicularly to the xz-plane, this offset is closed in the second configuration. In the second configuration, the second base 33 is folded down or placed downwards and in the horizontal position supplements the first base 29 into an essentially closed total base of the inner space.

In the second configuration, the movable two-person seating bench 3 is now pushed into the second shell element 7 and is directed to the window 35 in the first shell element 5 to the rear (in the x-direction). The alignment of the two-person seating bench 3 can be changed for example by a 180° rotation about a vertical axis (z-axis), after the two-person seating bench 3 has been removed from the shell elements 5, 7 (see FIG. 6). Alternatively or additionally to this, the seating and/or lying unit can comprises a back rest which can be repositioned or folded over, so that one can sit on the seating surface the other way round. The seating and/or lying unit then only need to be displaceable between the shell elements and does not need to be completely removed from the shell elements.

The sauna heating stove 49 stands at a maximum distance to the two-person seating bench 3 and the door in a corner region of the first shell element 5. In the second configuration, the sauna heating stove can be operated for taking a sauna. For this reason, an electrical connection 67 for the electrical operation of the sauna heating stove 49 is arranged at the outside on the first rear side 17. Additionally or alternatively, a gas connection for the connection of a propane gas bottle or another gas tank can be arranged at the location if the sauna heating stove 49 is to be operated with gas.

In FIGS. 3 and 4, the polyhedral shape contour of the outdoor furniture item 1 in the second configuration becomes clear, this essentially corresponding to the shape of a geometric prism with an essentially (with the exception of the offset which is closed by the panel 34) mirror-symmetrical pentagon as a base surface which is formed by the right side walls 21, 29 and the left side walls 23, 31 of the shell elements 5, 7. By way of the joining-together of the shell elements 5, 7, a garden shed with a gable roof is formed from the beach chair with a lean-to roof.

The hollow chamber structure of the first shell element 5 is shown in FIG. 4 in a detail. The second shell element 7 can have the same hollow chamber structure and/or a hollow chamber structure as shown in FIG. 2. Preferably, the sloped roofs 15, 25, the rear sides 17, 27 as well as the side walls 21, 23, 29, 31 all comprise a hollow chamber structure according to FIG. 2 and/or FIG. 4. The hollow chamber structure according to FIG. 4 comprises three wooden layers 53, 55, 69 with stagnant air gaps 57, 71 lying therebetween. A metal foil 59, 61, 73, 75 reflecting radiant heat and preferably comprising aluminum is arranged on the wooden layers 53, 55, 69 towards the air gaps 57, 71. Herewith, additionally to the thermal insulation by way of the stagnant air gaps 57, 71, the loss of radiant heat is reduced and the heating procedure can be greatly shortened with regard to time, so that the energy consumption is reduced. Furthermore, one can make do without fibre insulating materials which on the one hand are heavier and on the other hand can become damp and herewith lose their insulating effect and can tend to form mould. The metal foils 59, 61, 73, 75 furthermore serve as a vapor block, so that condensation water can run down on the metal foils and at the lower side can be led to the outside in a controlled manner for evaporation or for dripping off Compared to the hollow chamber structure according to FIG. 2, the hollow chamber structure according to FIG. 4 has the advantage that a greater insulating effect is achieved by two air gaps 57, 71 and a higher radiant heat reflection by four metal foils 59, 61, 73, 75, so that the sauna heating stove 49 can be operated with less power. In particular, this hollow chamber structure is suitable for the shell element which tends to be stationary (here the first shell element 5).

Figure 6:
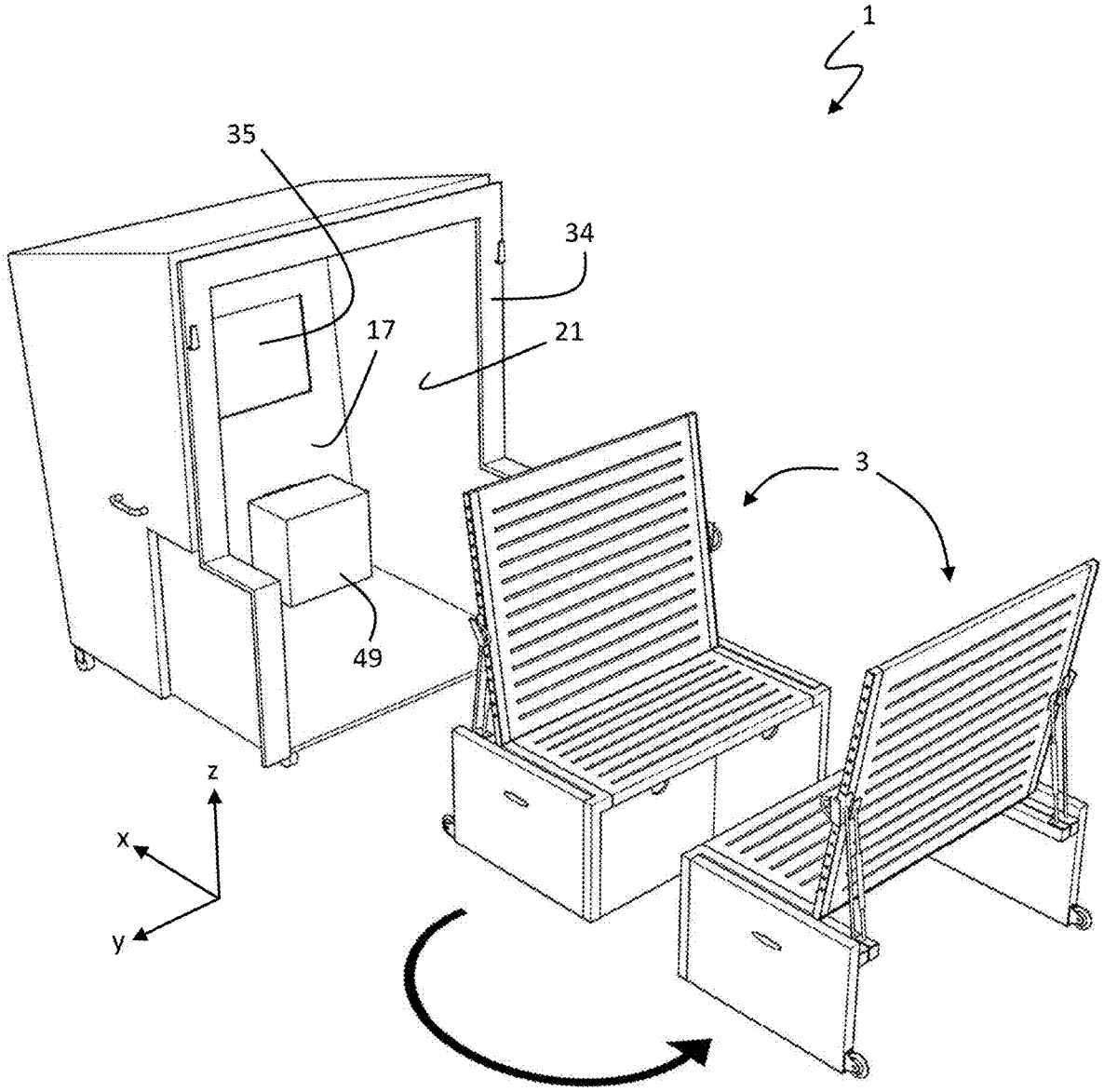
Figure 7:
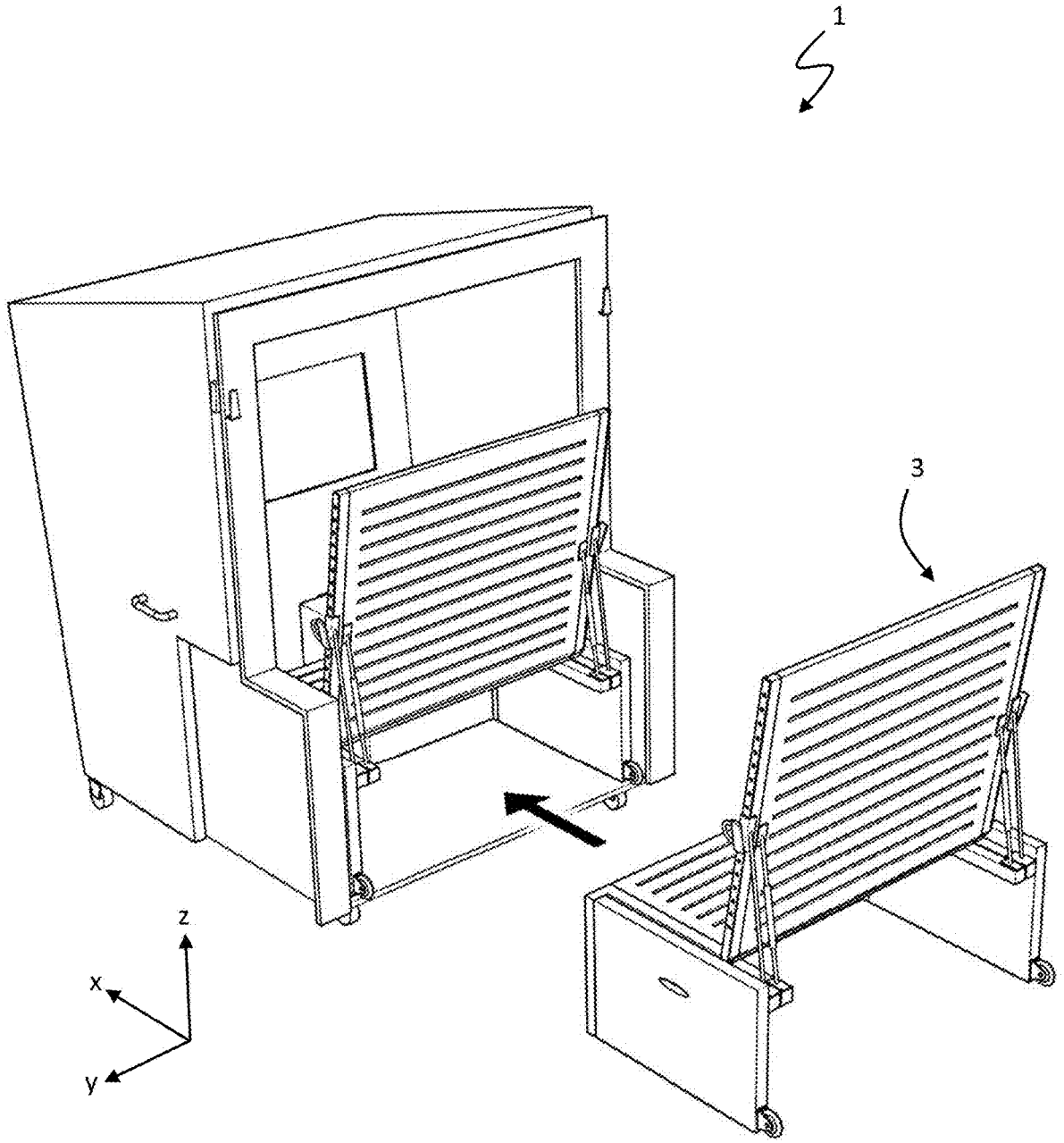

FIGS. 5 to 10 in steps show the conversion of the outdoor furniture item 1 from the first configuration into the second configuration. In FIG. 5, the two-person seating bench 3 is pulled out of the first shell element 5, in FIG. 6 is rotated about the vertical z-axis by 180° outside the first shell element 5 and hence in FIG. 7 is inserted back into the first shell element 5. Herein, the two-person seating bench 3 is not inserted in depth up to the first rear side 17, but only so deep that the entry region at the door 51 is not blocked from the inside by way of the two-person seating bench 3.

Figure 8:
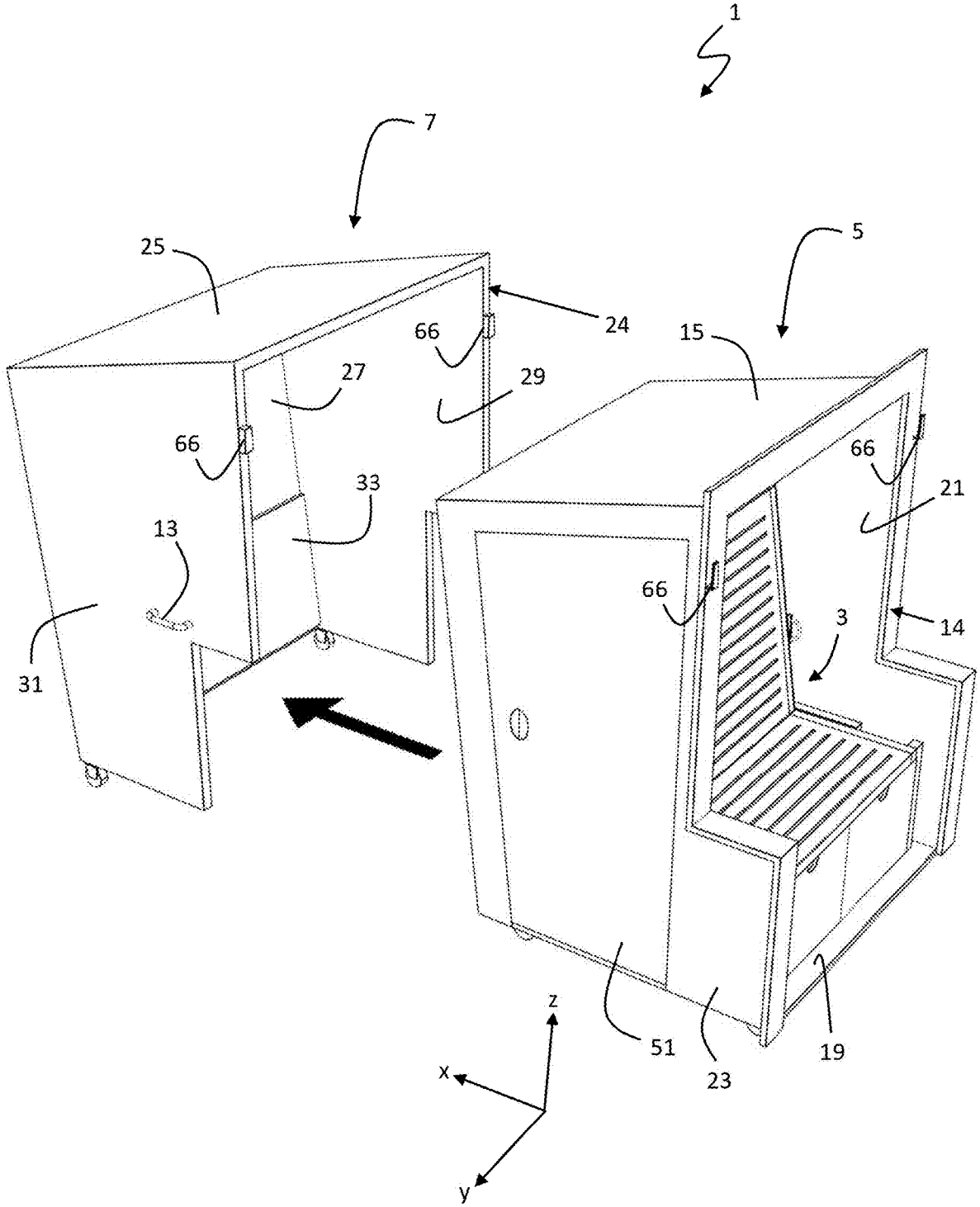
Figure 9:
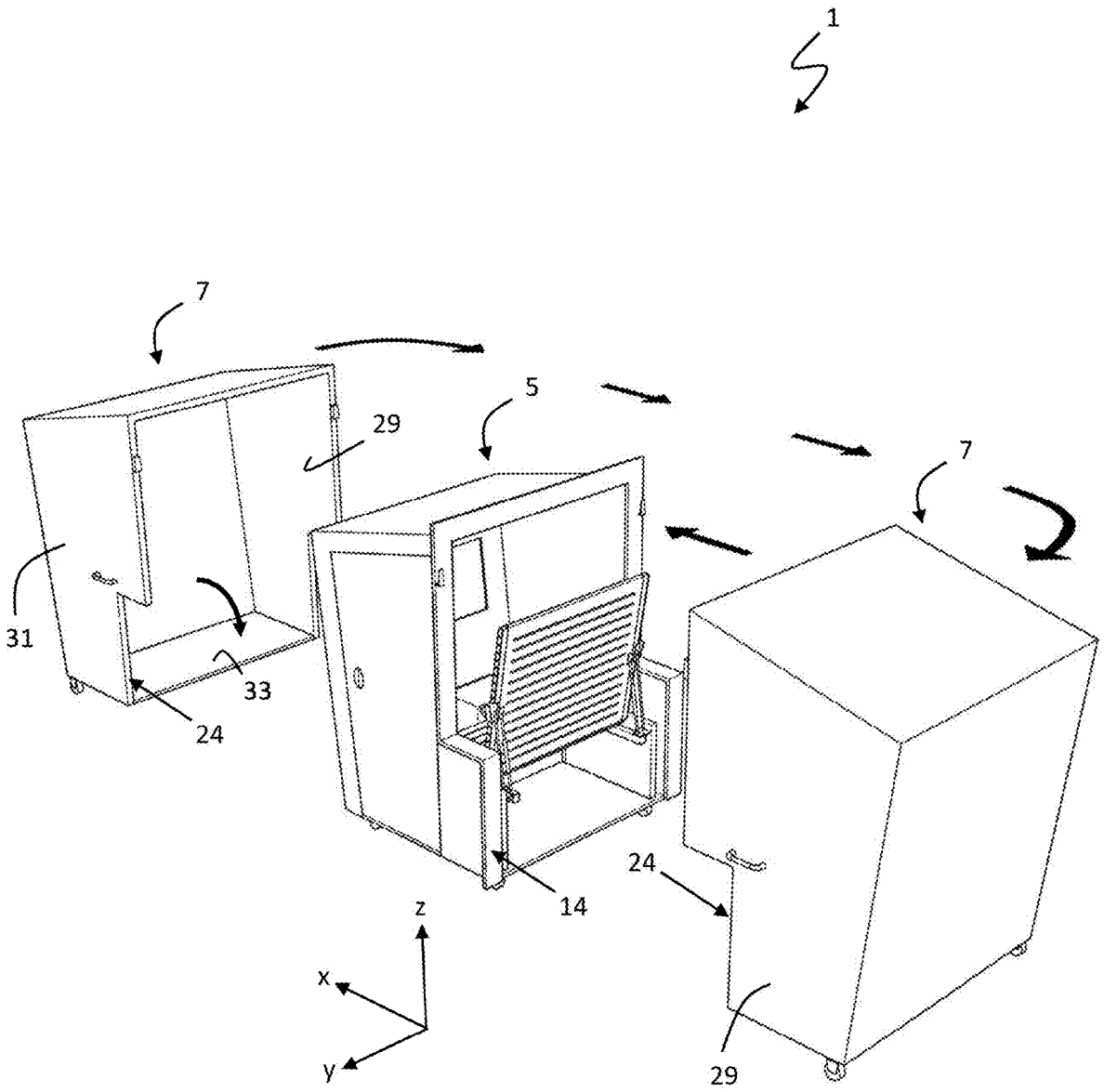
Figure 10:
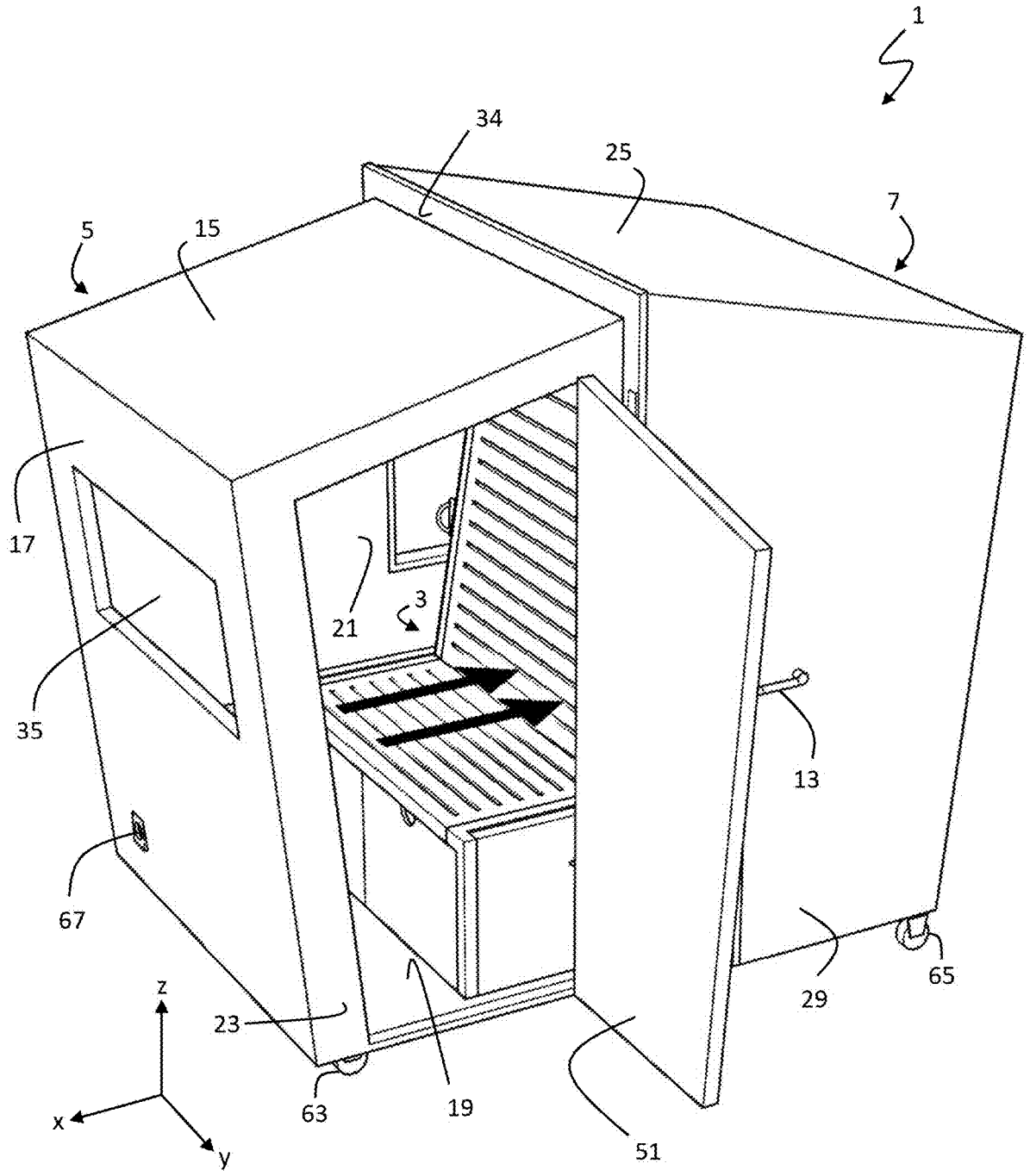

In FIG. 8, the second shell element 7 is then removed from the first shell element 5 by way of the grips 13 and according to FIG. 9 is rotated by 180° about the vertical z-axis and is applied from the front with the second front side 24 onto the first front side 14 which is formed by way of the panel 34. Prior to this, according to FIG. 9 the second base 33 was folded or placed downwards, so that horizontally it delimits the second semi-space 11 to the bottom. As is shown in FIG. 10, one enters the first semi-space 9 of the closed inner space which is now formed by the shell elements 5, 7, through the door 51 and pushes the two-person seating bench 3 onto the second base 33 onto the second rear side 27. The outdoor furniture item 1 is then situated in a second configuration. If the steps are carried out in the reverse direction, then the outdoor furniture item 1 can be brought back into the first configuration as a beach chair.

Figure 11:
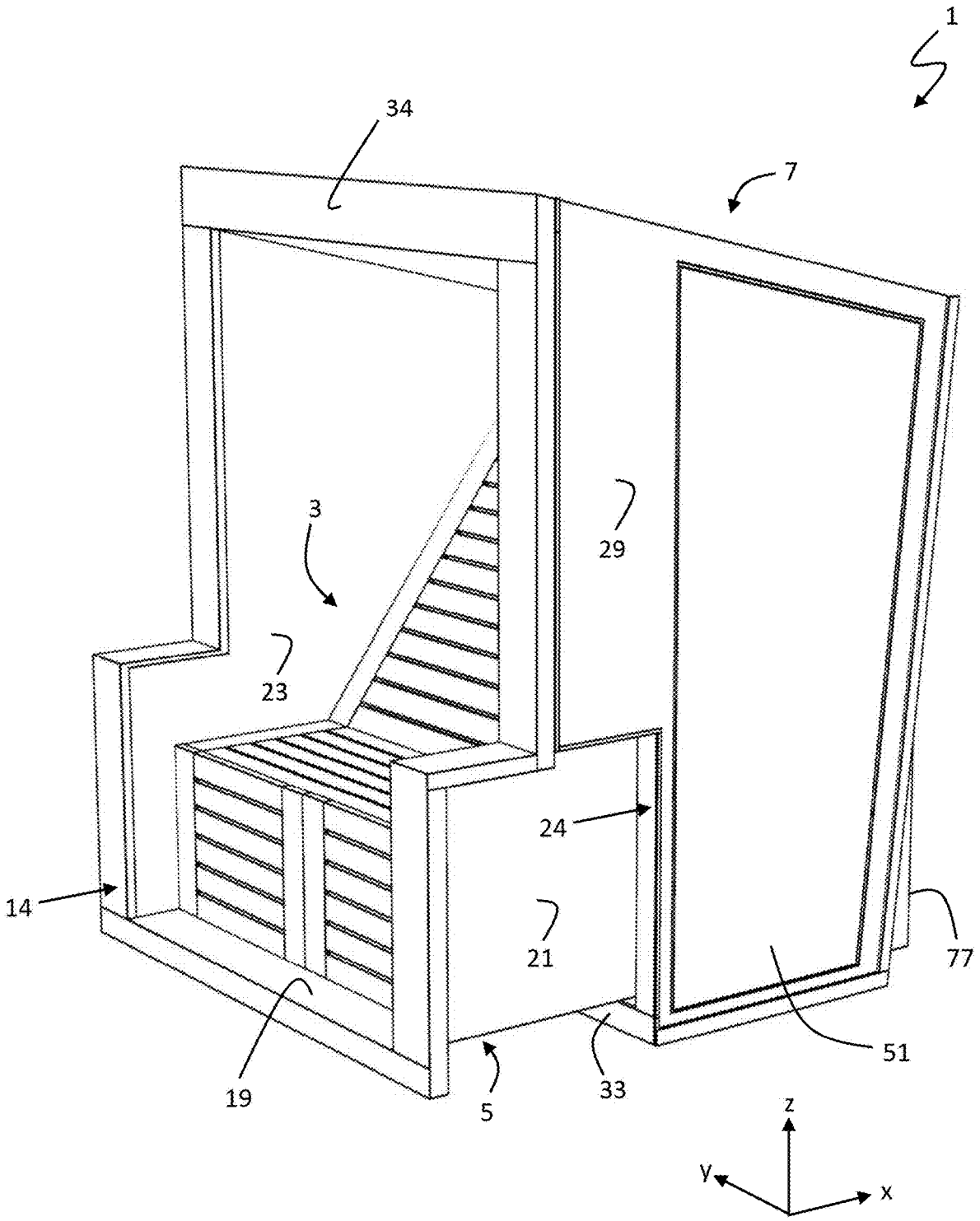
FIG. 11 is a perspective view upon an exemplary second embodiment of the outdoor furniture item which is disclosed herein, in the first configuration.
Figure 12:
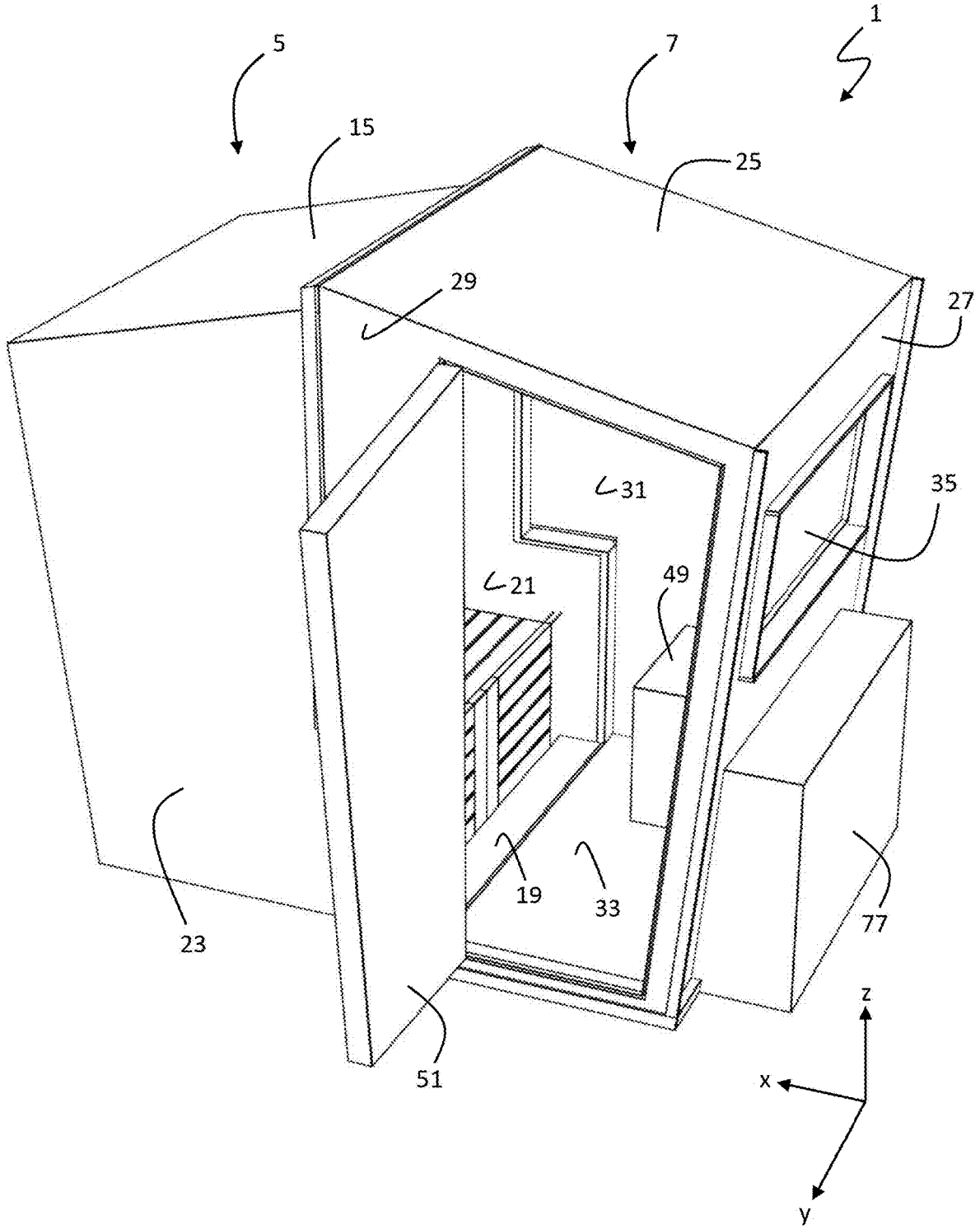
FIG. 12 is a perspective view upon an exemplary second embodiment of the outdoor furniture item which is disclosed herein, in the second configuration.

In FIGS. 11 to 13, a second embodiment of the outdoor furniture item 1 is shown, concerning which the seating and/or lying unit 3 can be fixedly arranged in the first shell element 5. The door 51 as well as the window 35 here is arranged in the second shell element 7. The sauna heating stove 49 is also located in the second shell element 7 in this configuration. In order for the sauna heating stove 49 to be able to be accommodated in the second shell element 7 in the nestled first configuration, the second shell element 7 on the second rear side 27 comprises a rearward bulging 77, in which the sauna heating stove 49 is stowed in the first configuration. In the second configuration (see FIG. 12), the sauna heating stove 49 can be pulled out of the bulging 77 into the interior, in order to operate it as a sauna. Otherwise, the construction of the outdoor furniture item 1 in the second embodiment is very similar to the first embodiment example according to FIG. 1-10. The second base 33 in the second shell element 7 however in the second embodiment example according to FIGS. 11-13 can be installed in a fixed manner and horizontally delimit the second semi-space 1 to the bottom. This increases the stability of the second shell element 7 since this in theory can be compromised by the door 51 and the window 35. Additionally to the fixed second base 33, it is advantageous for the stability to design the second sloped roof 25, the second rear side 27 as well as the second side walls 29, 31 in a more stable manner than in the first embodiment example according to FIG. 1-10. Herewith however, the second shell element 7 also becomes heavier, so that in the second embodiment example according to FIGS. 11-13 the weight difference between the first shell element 5 and the second shell element 7 can turn out to be smaller. For this reason, for the conversion from the first configuration (see FIG. 11) to the second configuration (see FIG. 12), the first shell element together with the fixedly installed seating and/or lying unit 3 can be pulled out of the second shell element 7, rotated about a vertical z-axis by 180° and placed with the first front side 14 onto the second front side of the second shell element 7. The second shell element 7 herein remains stationary. Alternatively to this, the second shell element 7 together with the sauna heating stove 49 can be pulled from the first shell element 5, rotated 180° about a vertical z-axis and placed with the second front side 24 onto the first front side 14 of the first shell element 5. The first shell element 5 herein remains in place.

Figure 13A:
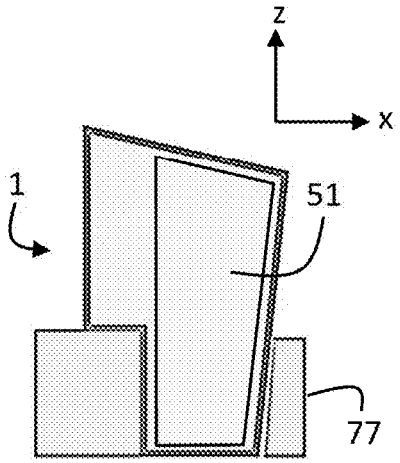
FIG. 13*a-f* are schematic longitudinal section views in the xz-plane through an exemplary second embodiment of the outdoor furniture item which is disclosed herein, in different phases of a stepwise conversion from the first configuration into the second configuration.
Figure 13B:
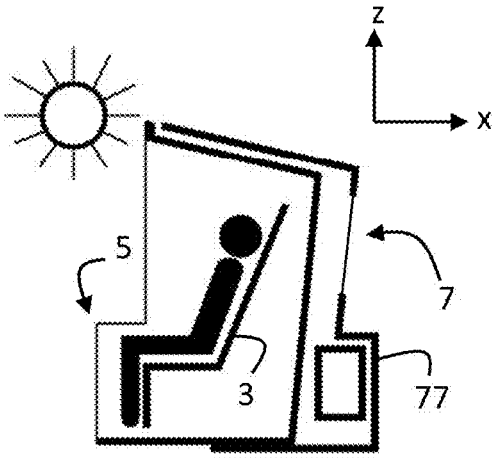
Figure 13C:
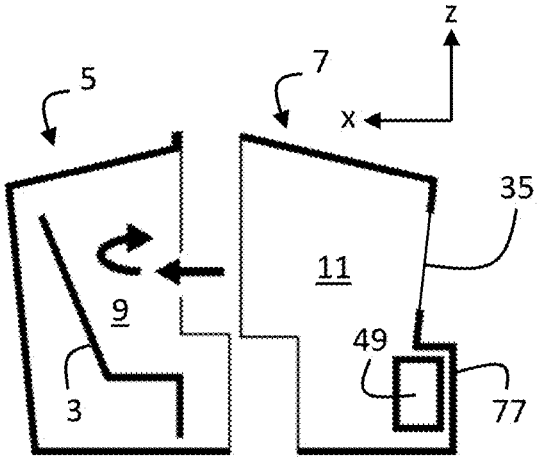
Figure 13D:
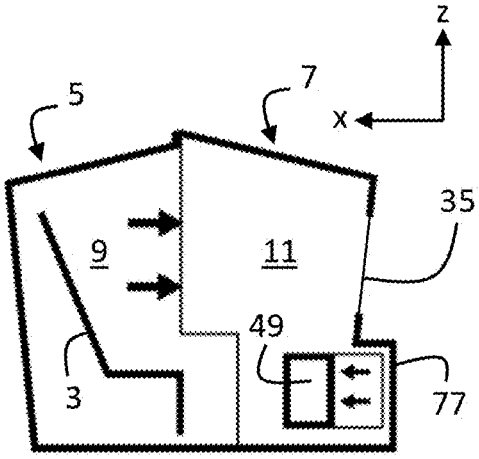
Figure 13E:
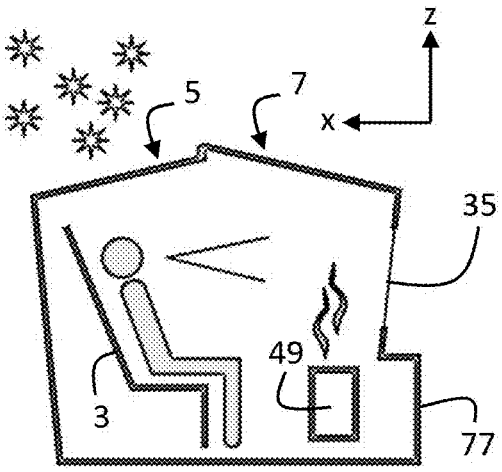
Figure 13F:
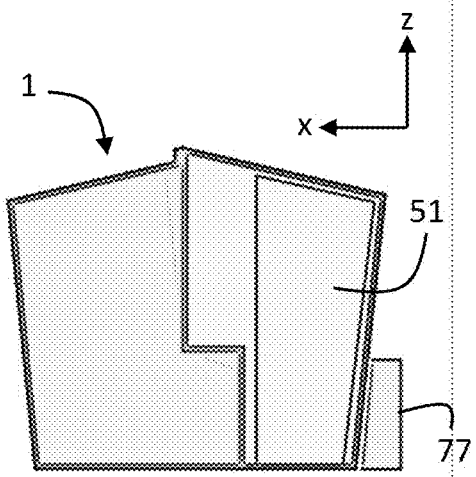

FIG. 13*a-f* in schematic sectioned views show the stepswise conversion from the first summer configuration (see FIG. 13*a, b*) into the second winter configuration (see FIG. 13*e, f*). The co-ordinate system which is randomly associated with the first shell element 5 here rotates between FIGS. 13*b* and 13*c*, since the first shell element 5 from FIG. 13*c* is rotated about the vertical z-axis by 180°. After the first shell element 5 in FIG. 13*d* has been placed with the first front side 14 onto the second front side 24 of the second shell element 7, the sauna heating stove 49 is pulled out of the bulging 77 into the inner space which is now formed by the hollow spaces 9, 11 of the shell elements 5, 7, in order to operate it in FIG. 13*e* for a sauna.

The numbered indications of the components or movement directions as "first", "second", "third" etc. have herein been selected purely randomly so as to differentiate the components or the movement directions amongst one another, and can also be selected in an arbitrarily different manner. Hence these entail no hierarchy of significance. A designation of a component or technical feature as "first" should not be misunderstood to the extent that there must be a second component or technical feature of this type. Moreover, any method steps, inasmuch as not explicitly stated otherwise or not compelling necessary, can be carried out in an arbitrary sequence and/or in a party or completely overlapping manner with regard to time.

Equivalent embodiments of the parameters, components or functions which are described herein and which appear to be evident to a person skilled in the art in light of this description are encompassed herein as if they were explicitly described. Accordingly, the scope of the protection of the claims is also to include equivalent embodiments. Features which are indicated as optional, advantageous, preferred, desired or similarly denoted "can"-features are to be understood as optional and as not limiting the protective scope.

The described embodiments are to be understood as illustrative examples and do not represent an exhaustive list of possible alternatives. Every feature which has been disclosed within the framework of an embodiment can be used alone or in combination with one or more other features independently of the embodiment, in which the features have been described. Whilst at least one embodiment is described and shown herein, modifications and alternative embodiments which appear to be evident to a person skilled in the art in the light of this description are included by the protective scope of this disclosure. Furthermore the term "comprise" herein is neither to exclude additional further features or method steps, nor does "one" exclude a plurality.

While specific embodiments of the invention have been shown and described in detail to illustrate the application of the principles of the invention, it will be understood that the invention may be embodied otherwise without departing from such principles.

The invention claimed is:

1. An outdoor furniture item comprising:

at least one seating and/or lying unit;

a first shell element;

a second shell element, wherein the first shell element and/or the second shell element can be selectively rearranged into a first configuration and into a second configuration with respect to the respective other shell element, wherein in the first configuration the first shell element and the second shell element are at least partly nested in one another and in the second configuration the first shell element and the second shell element together enclose an essentially closed inner space, in which the at least one seating and/or lying unit is located; and a sauna heating stove in the first shell element or in the second shell element.

2. An outdoor furniture item according to claim 1, wherein the first shell element defines a first semi-space which is open to a front side of the first shell element, and wherein the second shell element defines a second semi-space which is open to the front side of the second shell element, wherein the first shell element and the second shell element with regard to shape and size correspond to one another in a manner such that in the first configuration the first shell element essentially fills out the second semi-space.

3. An outdoor furniture item according to claim 2, wherein in the second configuration, the first semi-space and the second semi-space together form the essentially closed inner space, wherein the front side of the first shell element and the front side of the second shell element bear on one another directed toward one another.

4. An outdoor furniture item according to claim 2, wherein the second semi-space is wider and/or higher than the first semi-space.

5. An outdoor furniture item according to claim 1, further comprising: a panel which runs transversely to a front side and which in the second configuration closes the inner space at the transition between the shell elements.

6. An outdoor furniture item according to claim 1, wherein the at least one seating and/or lying unit is movable with respect to the first shell element and/or the second shell element.

7. An outdoor furniture item according to claim 1, wherein the second shell element comprises a base which is rearrangeable or can be folded over and which in the first configuration bears on a surface on a rear side and/or side wall of the second shell element and in the second configuration forms a base part of the essentially closed inner space.

8. An outdoor furniture item according to claim 1, wherein the first shell element and/or the second shell element comprises an outwardly opening door in a side wall thereof.

9. An outdoor furniture item according to claim 1, wherein in the first configuration the at least one seating and/or lying unit covers the sauna heating stove and in the second configuration the at least one seating and/or lying unit is arranged in the second shell element remotely from the sauna heating stove and is directed towards the sauna heating stove.

10. An outdoor furniture item according to claim 1, wherein the sauna heating stove is arranged in a corner region which is formed by a first side wall of the first shell element with a rear side of the first shell element, wherein a second, other side wall of the first shell element which lies opposite the first side wall comprises a door.

11. An outdoor furniture item according to claim 1, wherein the first shell element and/or the second shell element comprises walls with at least two solid body layers and at least one metal foil which lies between the solid body layers, and reflects radiant heat.

12. An outdoor furniture item according to claim 11, wherein an air gap lies between the solid body layers.

13. An outdoor furniture item according to claim 1, wherein the first shell element and/or the second shell element comprise essentially vertically running side walls, a rear side which is inclined to the rear by an angle $\beta$ in the range of 3° to 15° and a sloped roof which is inclined to the rear by a roof inclination $\gamma$ in the range of 5° to 20°.

14. An outdoor furniture item according to claim 13, wherein the roof inclination $\gamma$ is larger than the angle $\beta$.

15. An outdoor furniture item according to claim 1, wherein a front side of the first shell element is shouldered with a step shape such that a lower section of the front side of the first shell element projects with respect to an upper section of the front side of the first shell element.

16. An outdoor furniture item according to claim 15, wherein a front side of the second shell element is shouldered with a step shape corresponding to the front side of the first shell element such that a lower section of the front side of the second shell element is set back with respect to an upper section of the front side of the second shell element.

17. An outdoor furniture item according to claim 1, wherein the at least one seating and/or lying unit is movable with respect to the first shell element and/or the second shell element, including being insertable or rearrangeable into the first shell element and/or the second shell element as a separate unit.

18. An outdoor furniture item according to claim 10, wherein the door is configured to open to an outside.

19. An outdoor furniture item according to claim 11, wherein the at least one metal foil forms a vapor block, wherein the solid body layers are comprised of wood.

* * * * *